United States Patent [19]

Kudinov et al.

[11] 4,376,808

[45] Mar. 15, 1983

[54] LINING UNIT

[76] Inventors: Vladimir D. Kudinov, ulitsa Kosmonavtov, 82, kv. 29; Boris V. Filimonov, ulitsa Kirovogradskaya, 19, kv. 19, both of Sverdlovsk, U.S.S.R.

[21] Appl. No.: 197,757

[22] Filed: Oct. 16, 1980

[51] Int. Cl.[3] ..... F27D 1/04

[52] U.S. Cl. ..... 428/558; 428/564; 428/569; 266/280; 266/282

[58] Field of Search ..... 428/558, 564, 569; 266/280, 282, 283, 286; 138/141, 143, 153

[56] References Cited

U.S. PATENT DOCUMENTS

| | | | |
|---|---|---|---|
| 1,492,685 | 5/1924 | Hale | 266/280 |
| 1,733,403 | 10/1929 | Cushing | 266/282 X |
| 3,832,478 | 8/1974 | Books | 266/282 X |

*Primary Examiner*—G. Peters

*Attorney, Agent, or Firm*—Lilling & Greenspan

[57] ABSTRACT

The present invention relates to lining units used to protect surfaces exposed to intensive wear by solids, gases and liquids.

The lining unit is a metallic shell formed with a pipe of rectangular cross section, containing a metallic plate and a wear-resistant composite material, the shell, the metallic plate and the composite material being diffusion-joined one to another.

4 Claims, 6 Drawing Figures

LINING UNIT

The present invention relates to lining units.

BACKGROUND OF THE INVENTION

1. Field of the Invention

The invention can be used for protecting working surfaces of parts of various plants, exposed to intensive wear by solids, gases and liquids. The present invention is particularly suited for protecting working surfaces of various parts of large-size blast furnace (5000 and 300 $m^3$) charge conveyance system.

2. Description of the Prior Art

There are known large lining units composed of two steel sheets each 14 to 16 mm thick between which is placed a layer of a composite material, for example, one based on tungsten carbide, joined by diffusion to the above steel sheets.

However, characteristic of these lining units is a substantial specific consumption of rolled metal because of the need to retain the strength and the shape of the lining unit during the manufacture thereof, which includes a high-temperature heating. In addition, the costly composite material is utilized inefficiently in the known lining units because it is difficult to obtain a wear-resistant composite material layer of a thickness varying in accordance with the abradiung loads.

Another disadvantage of the above lining unit is its difficult manufacture, the process involving high consumptions of gas and electric power.

Also known is a lining unit composed of a metallic shell formed with a pipe of rectangular cross section filled with a wear-resistant material, for example, one based on tungsten carbide.

Although this design obviates some of the shortcomings inherent in the above-mentioned lining units, the use of a single type of rectangular cross section pipe provides no means for obtaining a lining unit having a variable-thickness wear-resistant layer to suit the conditions to which the unit is exposed in service.

Therefore, all the surfaces are protected on the assumption of maximum loads, thus leading to an inefficient consumption of the composite material.

It is therefore an object of the invention to provide a lining unit, so designed as to use efficiently the wear-resistant composite material.

SUMMARY OF THE INVENTION

The above and other objects are attained by a lining unit comprising a metallic shell formed with a rectangular cross section pipe filled with a wear-resistant composite material diffusion-joined to the metallic shell. According to the invention, the metallic shell carries an additional metallic plate diffusion-joined to the metallic shell and to the composite material.

The present invention has reduced roughly by one half the cost of the lining unit as compared to that of known ones through a lesser consumption of costly compounds entering the composite materials. Another advantage of the present invention is that, depending on concrete conditions, it is possible to substantially lower the weight (mass) of the lining unit.

According to the present invention, it is advisable when the lining units are used for protecting parts exposed to irregularly varying loads, for example, for protecting a crosspiece of a large bell of a 5000-$m^3$ blast furnace, to provide a metallic plate of a variable cross section throughout the length thereof.

In an alternative embodiment of the present invention, the metallic plate is wedge-shaped.

When lining elements are employed to protect large surface areas, it is advantageous, according to the present invention, to have the above metallic plate of a constant cross section throughout the length thereof.

BRIEF DESCRIPTION OF THE DRAWINGS

These and other objects and features of the invention become readily apparent from one embodiment thereof which will now be described by way of example with reference to the accompanying drawings, in which.

DETAILED DESCRIPTION OF THE INVENTION

Figure 1:
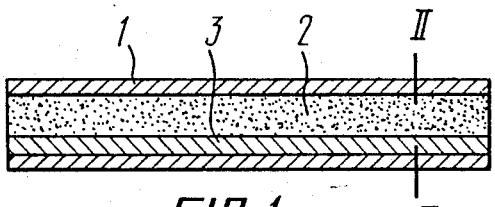
FIG. 1 is a cross sectional view of a lining unit according to the invention.
Figure 2:
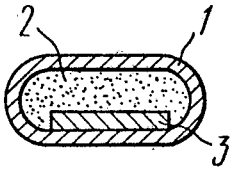
FIG. 2 is a cross sectional view on line II—II of FIG. 1.
Figure 3:
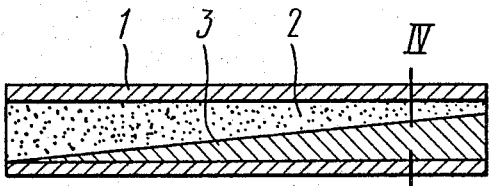
FIG. 3 is a cross sectional view of an alternative embodiment of a lining unit according to the invention.
Figure 4:
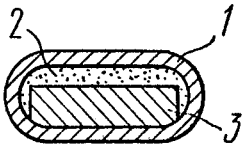
FIG. 4 is a cross sectional view on line IV—IV of FIG. 3.
Figure 5:
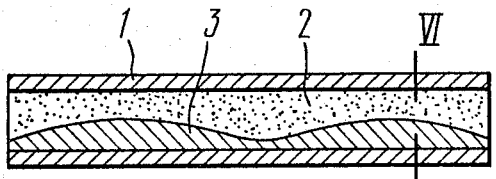
FIG. 5 is a cross sectional view of another alternative embodiment of a lining unit according to the invention.
Figure 6:
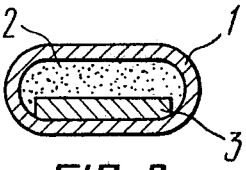
FIG. 6 is a cross sectional view on line VI—VI of FIG. 5.

A lining unit according to the present invention is a metallic shell 1 (FIGS. 1, 2, 3, 4, 5 and 6) formed with a pipe having a rectangular cross section of, for example, 120×25×5 mm, and 1000 mm long. The material for these pipes is usually low-carbon steel. The geometrical parameters of the shell 1 are selected so as to provide an optimum combination of weight, strength and processing characteristics.

The cavity of the metallic shell is filled with a wear-resistant composite material 2.

The base component of the wear-resistant composite material 2 is often tungsten carbides in grains measuring 0.16 to 2 or 3 mm across, the metallic binder for the material being cupronickel of the following composition: 20 weight % nickel, 20 weight % manganese, and the remainder, copper. Tungsten carbide grains usually account for 50 to 52 volume % of the composite material 2.

Substitutes for tungsten carbide may be sintered hard alloys which consist of grains measuring 0.16 to 4 mm across and are generally employed for making metal-cutting tools.

The wear-resistant matric of the above composite material 2 may also be other refractory metal alloys with high wear resistance, in grains of the above size.

The metallic binder may be in principle any metal having melting point not higher than 1000°–1050° C. and capable of wetting at the mentioned temperatures the particles of the wear-resistant material and the internal surface of the metallic shell 1.

The diffusion-joining of the metallic binder, the composite wear-resistant material and walls of the lining unit and the strength of the composite material 2 throughout the volume of the lining unit during the whole of the service life of the lining unit.

The operation of blast furnace charging arrangements and similar parts exposed in service to abrasive wear by solids and gases at ambient-air and elevated temperatures indicates that a uniform abrasive wear of working surfaces is a rare occurrence.

The need for obtaining a layer of a wear-resistant alloy of variable thickness was not as critical as it is today because less wear-resistant and, in consequence, cheaper alloys are employed. On the other hand, coating a working surface of a lining unit with a layer of the wear-resistant material 2 of variable thickness is a serious problem where known methods, such as welding arc facing or facing with large job-produced lining units, are employed.

This explains why today working surfaces are protected with a wear-resistant composite material 2 of constant thickness, which usually corresponds to a maximum load.

In the present invention, the variable cross section of a layer of the wear resistant material 2 is obtained by introducing inside the shell 1 a metallic plate 3 joined by a diffusion technique to the wear-resistant composite material 2 and to the metallic 1 formed with a pipe of rectangular cross section. The plate 3, according to the present invention, is placed tight against one of walls of the shell 1 and connected to the wall permanently (with no freedom of motion), for example, by brazing.

The material of the plate 3 is low-carbon steel.

The cross section of the plate 3 throughout the length thereof is calculated from the optimum parameters of operation of the lining unit as a whole.

The metallic plate 3 may be manufactured, depending on the loads it is exposed to, with a constant (FIGS. 1 and 2) or a variable (FIGS. 3 through 6) cross section throughout the length thereof. The cross section of the plate 3 is selected on the basis of the reciprocal of the abrasive wear. Where abrasive wear is high, the thickness of the composite material layer is increased by decreasing that of the plate 3. A variable cross section plate (FIGS. 3 through 6) may be wedge-shaped.

The configuration of the metallic plate 3 is a function of the abrasive wear, design and dimensions of a part that is protected with composite material standard lining units.

If the protected surface is substantially larger than a standard lining unit, and where the abrasive load is distributed irregularly over the surface of the part, use is then made of several lining units with metallic plates 3 of different thicknesses, but of constant cross section throughout the length of the lining units.

Where the dimensions of a surface being protected are comparable to those of an individual lining unit and the wearing load is distributed irregularly, employed are the lining units with the metallic plates 3 having variable cross sections throughout their lengths in accordance with a diagram showing the distribution of the wearing load.

Standard lining units with the wedge-shaped metallic plate 3 (FIGS. 3 and 4) are used when the wearing load is uniformly variable.

The concrete dimensions of the metallic plate 3 and the configuration of the cross section thereof may be established both theoretically and experimentally. The latter method is advisable in operation of such long-life plants exposed to heavy wearing loads, as, for example, charging arrangements of blast furnaces. The replacement at specified intervals of worn parts of the charging arrangements in the process of repairs provides a means for a fairly accurate determination of the wear each component undergoes under given conditions and, accordingly, for a correct selection of the dimensions and of the configuration of the plates.

No special equipment is needed for manufacturing lining units, whereas the manufacturing procedure includes steps employed in the production of known lining units.

The manufacture of the lining units according to the invention comprises the sealing of the shell 1; the heating thereof to a temperature of 1150°±50° C.; brazing of the plate 3 to the shell 1; and impregnation of, for example, tungsten carbides put inside the cavity of the shell, with a molten metal-binder. This procedure achieves diffusion joining of the composite material 2, the internal surface of the shell 1 and of the plate 3 one to another. The tearing strength of a soldered "plate-shell" joint is 44 to 46 kgf/mm$^2$.

This constructional arrangement makes it possible:

to organize the production of standard lining units with composite material filling on an economically optimum basis;

to utilize efficiently the scarce and the costly extra-wear-resistant materials;

to use heat treatment furnaces of relatively small sizes, so providing savings of fuel gas and electric power; and in many an instance, to lower the working cross sections of parts because of greater strength and stiffness of the standard lining units with metallic plates diffusion-joined to the shell, according to the invention.

What is claimed is:

1. A lining unit comprising: a metallic shell formed with a pipe of rectangular cross section; a metallic plate placed inside said metallic shell and diffusion-joined thereto; a wear-resistant composite material filling said metallic shell and diffusion-joined to said metallic shell and said metallic plate.

2. A lining unit as claimed in claim 1, wherein said metallic plate is of a variable cross section throughout the length thereof.

3. A lining unit as claimed in claim 2, wherein said metallic plate is wedge-shaped.

4. A lining unit as claimed in claim 1, wherein said metallic plate has a constant cross section throughout the length thereof.

* * * * *